United States Patent [19]

McDermott

[11] 4,151,735

[45] May 1, 1979

[54] RECOIL ASSEMBLY FOR ELECTROMAGNETIC HIGH ENERGY IMPACT APPARATUS

[75] Inventor: Arthur W. McDermott, Maple Valley, Wash.

[73] Assignee: The Boeing Company, Seattle, Wash.

[21] Appl. No.: 837,128

[22] Filed: Sep. 28, 1977

[51] Int. Cl.[2] ..... B21J 15/24

[52] U.S. Cl. ..... 72/430; 29/243.54; 29/421 M; 335/219

[58] Field of Search ..... 72/430, 56, 391; 29/243.52, 243.53, 243.54, 421 M; 335/209, 219, 220; 173/117; 83/575

[56] References Cited

U.S. PATENT DOCUMENTS

| | | | |
|---|---|---|---|
| 3,559,269 | 2/1971 | Schmitt | 173/117 |
| 3,584,496 | 6/1971 | Keller | 72/430 |
| 3,704,506 | 12/1972 | Orr | 29/243.54 |
| 3,731,370 | 5/1973 | Leltheris | 29/509 |
| 3,811,313 | 5/1974 | Schut | 173/117 |

*Primary Examiner*—C. W. Lanham
*Assistant Examiner*—Gene P. Crosby
*Attorney, Agent, or Firm*—Conrad O. Gardner; B. A. Donahue

[57] ABSTRACT

An apparatus for utilizing electromagnetic energy for producing high impact forces by means of a ram propelled against a work piece. The work center of the apparatus includes a ram assembly of bolted construction having a hollow ram shaft, which ram assembly includes a gap between opposing conductive surfaces including associated fastener screws of driving disc and ram shaft of at least about five-sixteenths of an inch. A solid mass recoil assembly provides integral housing and recoil mass, enabling aerostatic bearing functioning, and also lowers shock and vibration levels to operator and equipment.

3 Claims, 9 Drawing Figures

RECOIL ASSEMBLY FOR ELECTROMAGNETIC HIGH ENERGY IMPACT APPARATUS

This invention relates to electromagnetic high energy impact apparatus and more particularly to novel work center features and recoil arrangements for EMR (electromagnetic riveting) guns such as shown in U.S. Pat. No. 3,811,313 to Schut, also assigned to The Boeing Company.

Prior art EMR guns such as shown and described in the aforementioned U.S. Pat. No. 3,811,313 comprise recoil energy means, which includes a recoil spring leading for reasons hereinafter described to decrease in longevity of the electromagnetic high energy impulse coil. Increased number of parts in the aforesaid guns lead to problems of misalignment.

The above-referenced EMR guns utilized a solid ram shaft configuration in the work center leading to increased weight and temperature rise deleterious to operating characteristics of the EMR gun.

It is accordingly an object of this invention to provide an improved work center in an electromagnetic work tool, including a ram assembly having a hollow ram shaft.

It is a further object of this invention to provide means including a fastener arrangement and gap between ram shaft and driving disc in the work center of an EMR gun for preventing arcing.

It is yet another object of the present invention to provide energy absorbing recoil means in an EMR gun for enabling desired aerostatic bearing operation in the work center and preventing point contact loading of ram assembly with the coil assembly due to misalignment.

The above and further objects, features, and advantages of the present invention will become more clearly apparent from the following detailed description thereof which is to be read in conjunction with the drawings in which:

FIG. 1 shows a cut-away view of prior art EMR gun shown in U.S. Pat. No. 3,811,313 with portions shown in cross section for clarity;

Figures 6, 7, 8, 9:
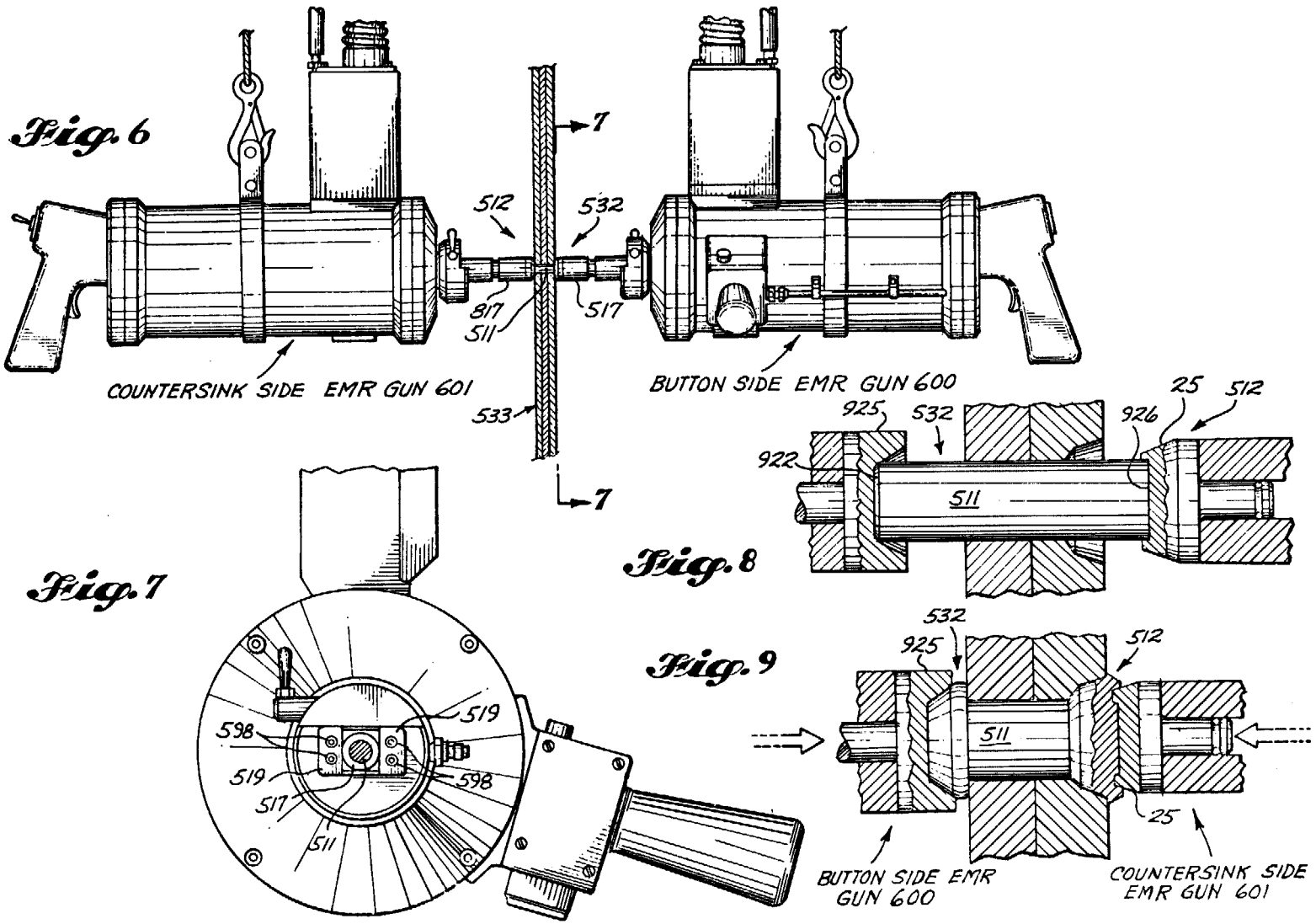
FIG. 6 is a side elevation of a system of EMR guns of the type shown in FIGS. 2 through 5 deployed for riveting procedure.
FIG. 7 is a front elevational view of the system of FIG. 6 taken along the lines 7—7 of FIG. 6.

FIG. 8 is a vertical sectional view showing die portions of the working EMR guns of the system of FIG. 6 about a slug rivet in a workpiece prior to pulse coil energization of the EMR gun of the system of FIG. 6; and FIG. 9 is a vertical sectional view showing die portions and rivet formation in the workpiece shown in FIG. 8 subsequent to pulse coil energization of the EMR guns of the system of FIG. 6.

Figure 1:
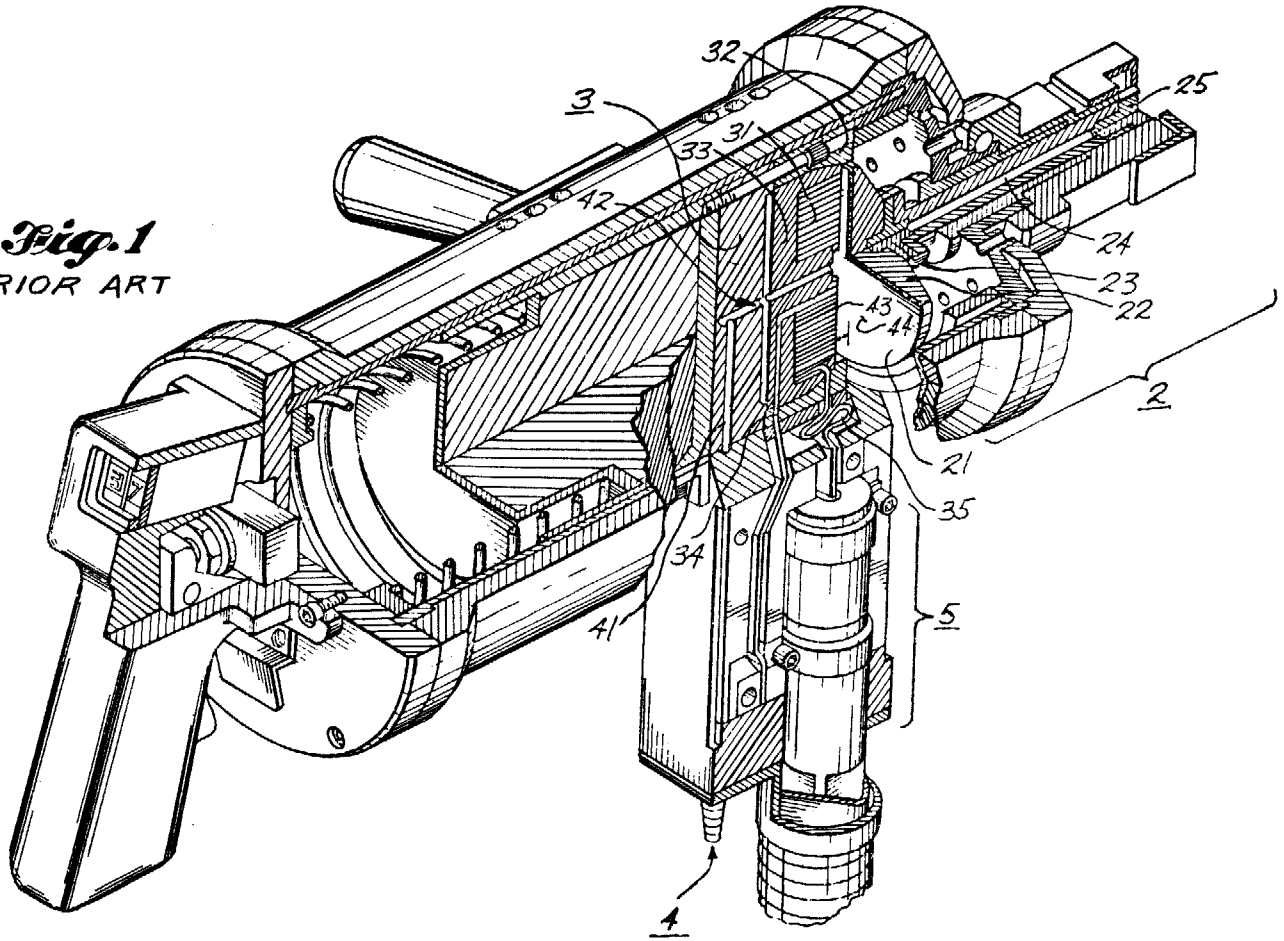
Fig. 1 PRIOR ART
Figure 2:
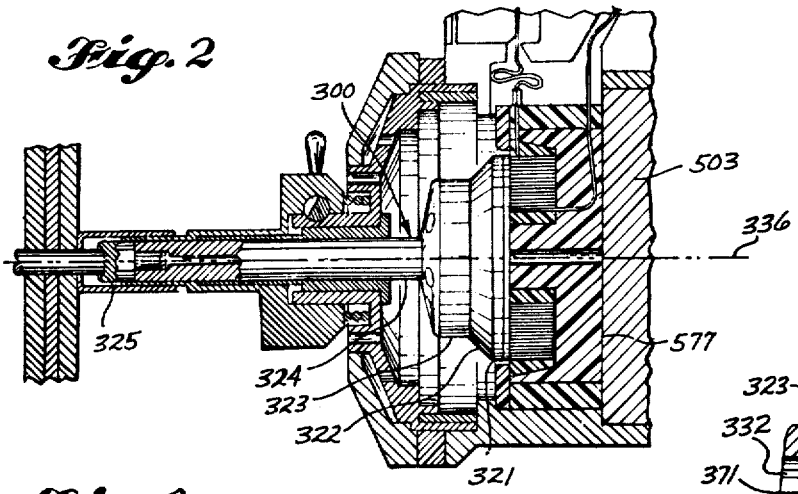
FIG. 2 is a vertical sectional view with parts cut away of the novel ram assembly 300 as utilized in the work center of the EMR gun of FIG. 1.
Figure 3:
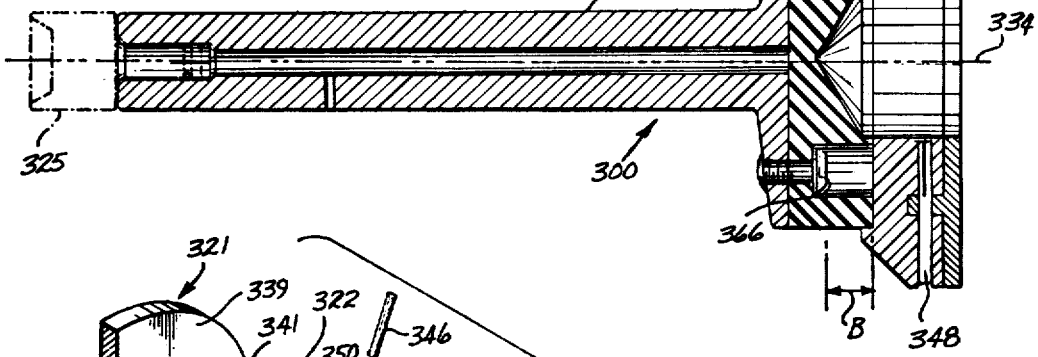
FIG. 3 is a vertical sectional view of the ram assembly 300 of FIG. 2.
Figure 4:
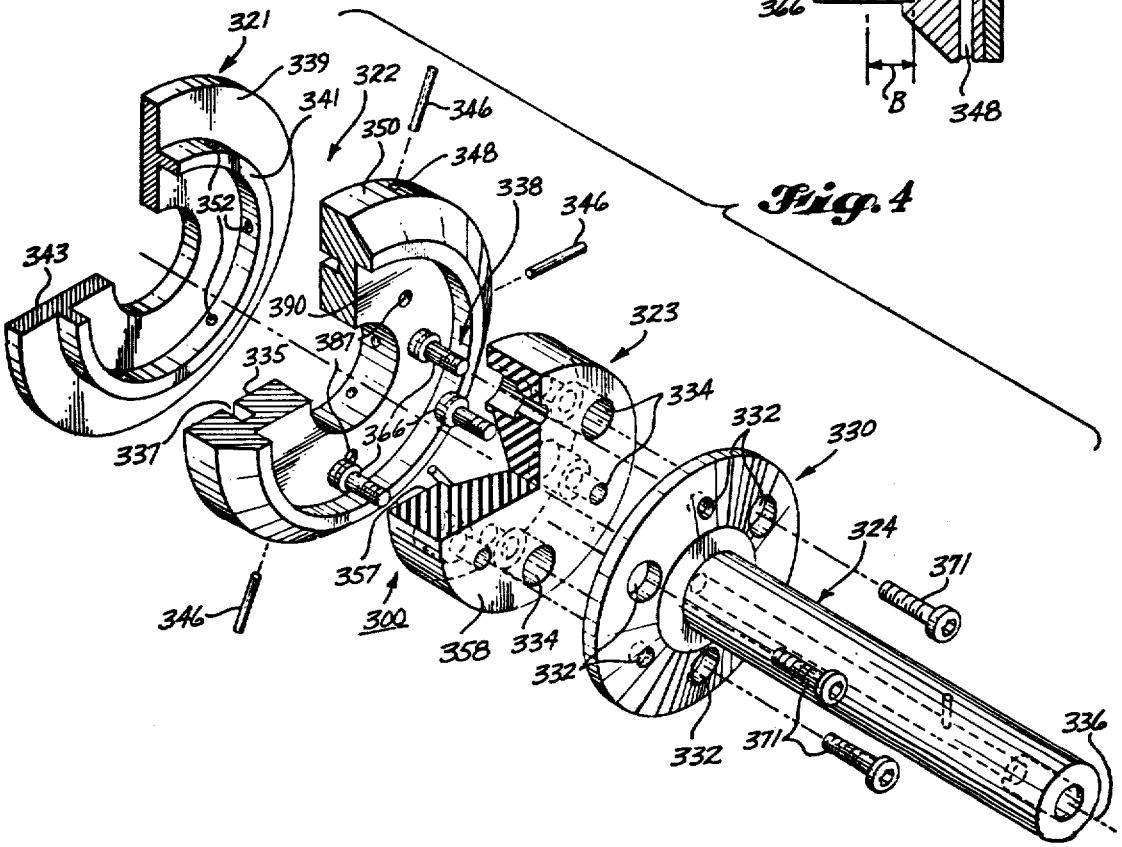
FIG. 4 is an isometric exploded view of ram assembly 300 of FIG. 3.

Turning now to FIG. 2, ram assembly 300 in accordance with an embodiment of the present invention will be seen to comprise an assembly of structures including conductive driving plate 321, driving disc 322, insulator plug 323, ram shaft 324 and forming die 325. Ram assembly 300 shown in more detail in FIGS. 3 and 4 may be compared with the aforementioned prior art ram assembly 2 of the EMR gun of FIG. 1 and seen initially to comprise an assembly of bolted construction compared to the adhesively bonded assembly of the type shown in FIG. 1 with attendant features and advantages hereinafter described. Tubular shaped ram shaft 324 includes a flange-like end portion 330, end portion 330 having a plurality of holes (six) 332 drilled therethrough which are equiangularly disposed about the circumference of flange-like end portion 330. The tubular shape of ram shaft 324, while reducing the weight thereof, further provides reduced temperature rise during operation. Cylinder-like insulator plug 323 also has a plurality of holes (six) 334 drilled therethrough with their centers located along longitudinal axis parallel to the central axis 336 and passing through the centers of holes 332 so as to match up. Driving disc 322 comprises the head of ram assembly 300, driving disk 322 being provided in a first major surface abutting insulator plug 323 with a centrally located cavity 338 of cylindrically shaped volume for seating therewithin the abutting opposing first major surface region 357 of insulator plug 323, the second major surface 335 of driving disk 322 being provided with a circumferentially disposed groove 337. Disk-shaped conductive driving plate 321 is provided on first major surface 339 opposite working surface 343 with a circumferentially disposed ring-like portion 341 protruding from surface 343 a predetermined distance about equal to the depth of groove 337 so as to seat therein, thereby providing flush mating of surfaces 335 and 339. A plurality of roll pins 346 are inserted through a plurality of equiangularly disposed radially extending holes 348 provided in the outer circumferential surface 350 and matching corresponding holes 352 extending radially through ring-like portion 341, thereby retaining in an assembled condition conductive driving plate 321 and driving disk 322. Half of holes 334 passing through insulator plug 323 are countersunk in first major surface region 357 to receive heads of a first set of machine screws 366, which are secured in mating juxtaposed ones of holes 332 of flange-like end portion 330 of ram shaft 324 tapped to receive them while the remaining half of holes 334 are countersunk in the second major surface region 358 to receive heads of a second set of machine screws 371, which are secured in mating juxtaposed ones of holes 387 tapped in the bottom surface 390 of centrally located cavity 338.

A predetermined distance of at least about five-sixteenths (5/16) of an inch (denoted as B in FIG. 3) is maintained between the head surfaces of first set of machine screws 366 and the facing surface of driving disc 322 while the same predetermined distance of at least about five-sixteenths (5/16) of an inch (denoted as A in FIG. 3) is provided between the head surfaces of second set of machine screws 371 and the facing surface of flange-like end portion 330 of tubular ram shaft 324, thereby preventing arcing across gaps A and B even in the case of a damaged coil. The aforementioned ram assembly 300, which eliminates the use of adhesives, thereby providing structural soundness, is seen from the preceding to provide for reduced temperature rise during operation and further prevent incidences of arcing, which factors significantly affect the life of the EMR gun. The hereinbefore described ram assembly, also provided with flange-like end portion 30 for distributing force evenly to insulator plug 323, permits increased size insulator plugs at 323, thereby providing for reduction in unit loading of the plug (a cause of breakage) and consequent increase in cycling capability.

Figure 5:
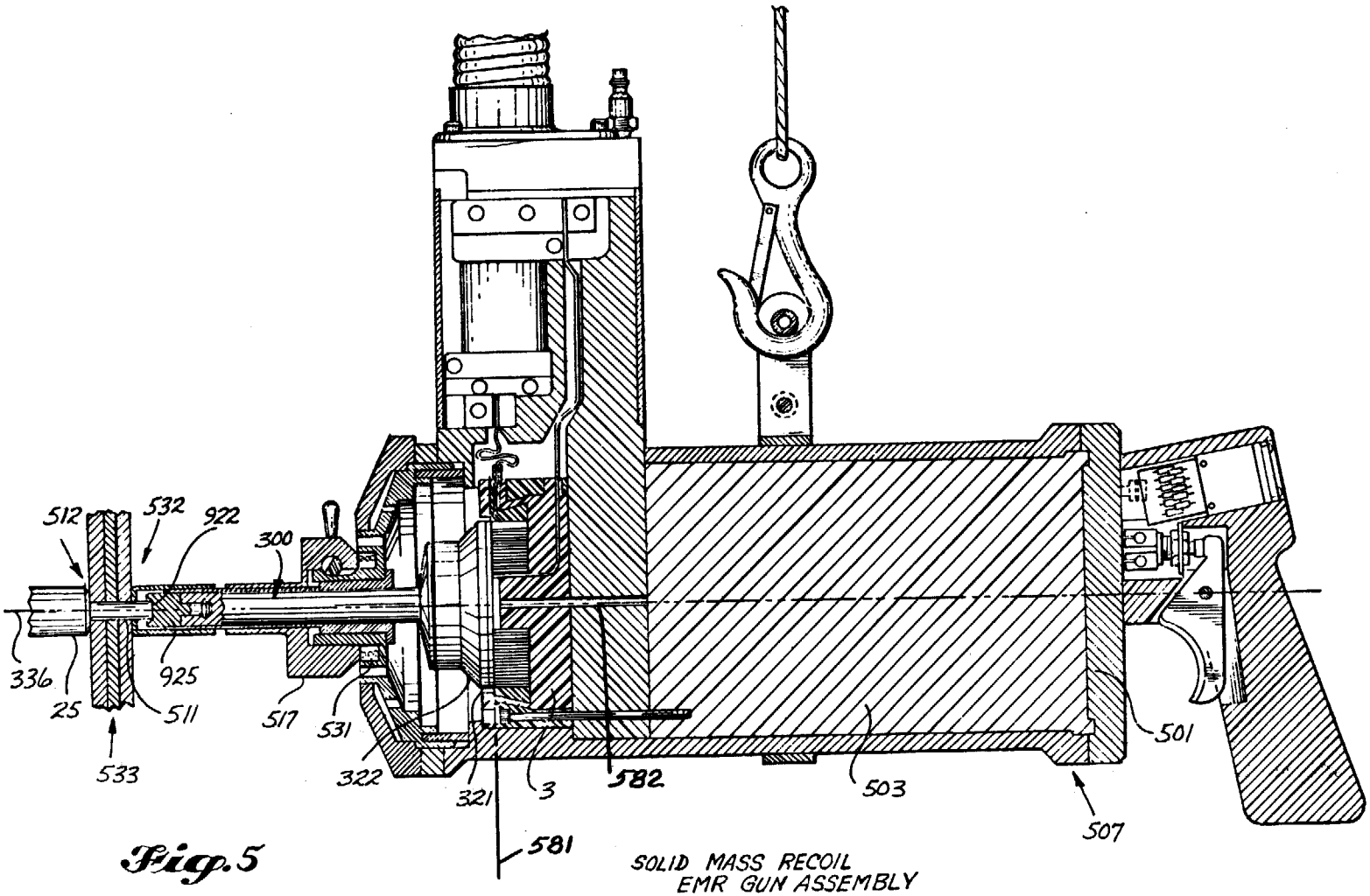
FIG. 5 is a vertical section of the EMR tool in accordance with the embodiment of FIGS. 2 through 5 showing in detail the present novel recoil assembly.

Turning now to FIG. 5 and briefly comparing with the prior art EMR gun structure of FIG. 1, it will be observed that the FIG. 1 EMR gun structure utilized an internal spring-loaded recoil mass. Such machined fit of the sliding recoil mass to the outer housing sleeve with resultant wear during operation tended to preclude obtaining and maintaining of the tolerances necessary to achieve the full benefit and results of the aerostatic bearing function hereinbefore mentioned with respect to the description of FIG. 1. The FIG. 1 structure with such machine fit and aforementioned consequent resultant misalignment problem further tended to fail to prevent point contact loading of ram assembly 2 with the pulse coil assembly 3, thereby causing advanced deterioration of the pulse coil and ram assembly. In FIG. 1 the aerostatic bearing means comprises respectively the bearing fluid supply channel 41 coupled to the fluid input 4, the restriction 42 in series therewith, and the bearing surfaces 43 and 44 coupled in the fluid flow path subsequent to restriction 42. The pressurized fluid is passed through the supply line 41, encounters a pressure drop by passing the restriction 42 and next flows to atmospheric pressure inbetween the bearing surfaces 43 and 44. Regulation of the supply pressure and restriction dimensions create a fluid cushion between the bearing surfaces 43 and 44 which physically separates the working face of the coil 31 and driving plate 21. As stated before, primary purposes of the aerostatic bearing are to protect the coil face 43 from damage caused by possible physical coil face 43 to driver bearing surface 44 formed by plate 21 contact while simultaneously allowing for a continuous transfer of heat dissipated at the coil and driver surfaces 43 and 44 respectively through the constant flow of bearing fluid.

Turning now to FIG. 5, it will be seen that recoil assembly 503, comprises a solid steel or lead mass of about 58 pounds disposed in the recoil assembly volume formed between the inner surface of rear wall 401 of EMR dilectric gun housing 507 and a first major surface of electromagnetic pulse coil assembly 3 (with front wall 577 of recoil assembly 503 machined perpendicular to centerline 336 of ram assembly 300; see FIG. 2 in this regard), thereby holding the second major surface 581 of electromagnetic coil assembly 3 (which faces conductive driving plate 321) perpendicular to the centerline 336 of ram assembly 300 so that the aerostatic bearing discussed earlier in connection with FIG. 1 and similarly formed herein in FIG. 5 between the aforementioned second major surface 581 of electromagnetic coil assembly 3 and conductive driving plate 321 may function as intended and so that point contact between conductive driving plate 321 and coil face is reduced. In FIG. 1, aerostatic bearing surfaces 43 and 44 are seen to correspond to surfaces 321 and 581 of FIG. 5 and bearing fluid supply channel 41 of FIG. 1 is seen to correspond to 582 of FIG. 5. Recoil assembly 503 mass of about 58 pounds provided in the aforementioned recoil assembly volume is achieved through the above-mentioned use of a solid lead or steel mass. The aforementioned integral structuring of recoil assembly 503 because of increased mass and solid construction further tends to reduce shock and vibration levels and resultant wear and tear on components of the present EMR gun and yields consequent important increase in longevity of electromagnetic high-energy impulse coil.

Controlled protrusion of the countersink side 512 of slug rivet 511 is provided in operation by deploying a countersink rivet-forming die 25 (as shown in more detail in FIGS. 8 and 9) of selected predetermined height to obtain a particular desired protrusion setting instead of utilizing variable stops disposed within the EMR gun shown in the prior art EMR gun of FIG. 1. It can be seen that springs 531 provide spring loading of normality nose piece 517 on button side 532 allowing direct series contact of slug rivet 511, ram assembly 300 and coil face of coil assembly 3, thereby permitting movement of normality nose piece 517 on button side 532 forward against assembly 533 to close off air ports between assembly 533 and normality nose piece 517 for indication of alignment of EMR gun.

FIG. 6 is included to show disposition of a pair of EMR guns 600 and 601 of the type shown in FIGS. 2–5 juxtaposed about slug rivet 511 prior to firing for securing the structure 523. The use of the novel spring-loaded nose piece 517 and selection of variable height rivet dies at 25 as seen in FIGS. 8 and 9 preclude use of internal shimming of forward coil stroke to control protrusion as was done in FIG. 1 systems. All protrusion adjustments are thus seen in the present system to be done external to the gun housing and allow for variations to exist in coil and ram height. EMR gun 601 on countersink side 512 in contrast is provided with nose piece 817 which is rigid and of the same type utilized in FIG. 1.

FIG. 7 shows in more detail the working tip of EMR gun of FIGS. 2–5, two of which are denoted at 600 and 601 in the system of FIG. 6. In FIG. 7 it can be seen that normality air nose piece 517 of FIG. 5 includes a pair of rubber tips 519, each of tips 519 further including a pair of air holes 598 hereinbefore mentioned for providing indication of alignment of the EMR gun.

In FIG. 6, aforementioned normality air nose piece 517 is shown on EMR gun 600 on button side 532 and the only difference between EMR guns 600 and 601 can be seen in FIGS. 8 and 9 where it can be observed that EMR gun 600 on button side 532 is seen to include conically formed rivet-forming die 925 having face portion 922, and EMR gun 601 on countersink side 512 is seen to include a cavity-shaped rivet-forming die 25 having a face portion 926 so shaped. The distance between rubber tips 519 on the normality air nose piece of the EMR gun (e.g. EMR gun 601 on the countersink side to cavity-shaped face portion 926) controls the amount of protrusion effected upon synchronized substantially simultaneous firing of both EMR guns 600 and 601 with the result shown in FIG. 9. Protrusion is varied as noted earlier by changing rivet dies on either button side 532 or countersink side 512. The work cycle as known in the art and as utilized in paired systems of EMR guns of the type shown in FIG. 1 is not detailed herein, however, it consists of charging of a capacitor bank to a preset voltage (energy level) followed by a rapid discharge thereof through the two series-connected coils of the diametrically opposed hand-held guns 600 and 601 of FIG. 6.

I claim:

1. A recoil assembly for use in an electromagnetic work tool housing enclosure having: an electromagnetic high energy pulse coil including a working face; a ram assembly including a conductive driving plate, and aerostatic bearing means comprising opposing surfaces of said working face and said conductive driving plate; the improvement wherein said recoil assembly comprises a solid metallic mass disposed between the inner surface of a rear wall of said housing and a major surface of said electromagnetic high energy pulse coil opposite said working face, said solid metallic mass having the front surface thereof facing said major surface of said electromagnetic high energy pulse coil opposite said working face machined perpendicular to the centerline of said ram assembly, thereby holding the working face of said electromagnetic high energy pulse coil perpendicular to said centerline of said ram assembly and maintaining substantially parallel the opposing surfaces of said aerostatic bearing means.

2. The invention according to claim 1 wherein said solid metallic mass has a weight of about 58 pounds.

3. The invention according to claim 1 wherein said solid metallic mass comprises lead or steel.

* * * * *